US005731756A

United States Patent [19]

Roddy

[11] Patent Number: 5,731,756

[45] Date of Patent: Mar. 24, 1998

[54] UNIVERSAL ENCRYPTED RADIO TRANSMITTER FOR MULTIPLE FUNCTIONS

[75] Inventor: Timothy S. Roddy, Plymouth, Mich.

[73] Assignee: United Technologies Automotive, Inc., Dearborn, Mich.

[21] Appl. No.: 728,559

[22] Filed: Oct. 10, 1996

[51] Int. Cl.[6] ..... G08B 1/08

[52] U.S. Cl. ..... 340/539; 340/506; 340/517; 340/521; 340/522; 340/692; 340/825.31; 340/825.32; 340/825.36; 380/43

[58] Field of Search ..... 340/521, 541, 340/542, 632, 694–696, 634, 635, 633, 506, 517, 522, 825.31, 825.32, 825.36, 825.44, 825.5, 825.56, 825.69, 825.72, 825.53; 380/9, 23, 25, 43

[56] References Cited

U.S. PATENT DOCUMENTS 4,360,801 11/1982 Duhame ..... 340/521

5,363,448 11/1994 Koopman, Jr. et al. ..... 380/23

5,377,270 12/1994 Koopman, Jr. et al. ..... 380/25

*Primary Examiner*—Thomas Mullen

*Assistant Examiner*—Daryl C. Pope

*Attorney, Agent, or Firm*—Howard & Howard

[57] ABSTRACT

A control is provided for allowing a user to actuate various home security systems such as garage door openers, home alarm systems, lights, etc., remotely. A transmitter is provided with encryption logic such that its signal is not easily duplicated. In a preferred embodiment, the transmitter is provided with separate channels for each of several systems which are to be actuated by the transmitter. Receivers are provided with logic to recognize the encrypted signal. The encrypted signal varies sequentially on each actuation of the transmitter. In another preferred feature of this invention, add-on receivers may be incorporated into the existing circuitry for the systems that are to be controlled by the inventive transmitter. In this way, existing systems may be utilized with the inventive transmitter.

13 Claims, 3 Drawing Sheets

UNIVERSAL ENCRYPTED RADIO TRANSMITTER FOR MULTIPLE FUNCTIONS

BACKGROUND OF THE INVENTION

This Application relates to a transmitter to actuate several home security systems, such as garage door openers, home alarm systems, etc., wherein the transmitter signal is encrypted.

Remote transmitters to control the actuation of several security systems in the home are known. Remote transmitters to actuate a garage door opener are often placed in vehicles such that the driver of the vehicle may open the garage door when approaching the home. More recently, the same transmitters have been provided with the ability to actuate or turn off a home alarm system. Additionally, the transmitters will sometimes be provided with the ability to actuate external or internal lights.

The known transmitters send a signal selected from a number of available signals, which is recognized by a receiver to actuate the particular system. In the known systems, a different signal is necessary to actuate the garage door, the home alarm system, the lights, etc.

Known systems typically utilize a permanent signal. With permanent signals, a criminal may monitor and record the signal transmitted by the transmitter. Once having captured the signal, the criminal is then able to return to the home later, and utilize the captured signal to actuate the garage door opener, alarm system, etc. This is obviously an undesirable result.

Merely scrambling the signal will not solve this problem. The signal captured by the criminal would still be the signal expected by the receiver, albeit scrambled.

Encryption technology has been used in remote vehicle door entry systems. In known encryption technology a counter is provided at both the transmitter and the receiver, and the encryption changes sequentially with the count. On a first iteration, the transmitter control will send a first encrypted signal and the receiver will know to look for that first signal. On each subsequent iteration, different variations of the signals are sent. Since the receiver will know which iteration to expect, it is able to recognize a proper signal. Encryption technology has not been utilized in combination with remote actuation of home security systems such as the systems described above.

SUMMARY OF THE INVENTION

In a disclosed embodiment of this invention, a transmitter for actuating systems such as garage doors, home alarm systems and lights is provided with logic, which encrypts at least some of the signals. Receivers for the systems that are to be actuated by the encrypted signal are provided to recognize the encrypted signals. Preferably, the encrypted signal is one wherein the encryption performed varies sequentially. That is, upon a first actuation of the transmitter, the encryption will be different than on the second actuation. However, the encryption at each actuation will be recognizable to a receiver that "knows" the sequence of actuations.

A problem with providing encrypted signals for home security systems is that most consumers have pre-existing home security systems. Moreover, it would be impractical to require the manufacturers of the home security systems to communicate with vehicle manufacturers such that the vehicle based transmitter is designed in combination with the receiver for the home security system. Moreover, since the preferred transmitter must control several different security systems, it would also be impractical for the manufacturers of the several different systems to cooperate. For that reason, there are practical difficulties with designing home security systems to recognize encryption technology.

This invention provides add-on receivers which are incorporated into the existing home security system. As one example, a receiver which is adapted to recognize the encrypted signal from the transmitter may be incorporated into the garage door opener circuit. The encrypted receiver may be a device which actuates a switch when an acceptable signal is received, and thus actuates the garage door opener. The switch may act in parallel to a circuit provided on the garage door opener for actuation by a button such as provided in a user's home. This receiver compares a received signal to an expected signal. If the received signal matches the expected signal then a signal is generated to actuate the garage door opener. In this way, the problems mentioned above with regard to providing an encrypted receiver into the existing system are overcome.

Similarly, an encrypted receiver may be incorporated into a home alarm system. One disclosed example includes connecting the receiver into the key pad circuit for the home alarm system. When this receiver receives an acceptable signal, it then provides a signal to the functions as if the key pad had been properly operated to actuate or deactuate the home alarm system.

To protect against a criminal capturing a signal, and then waiting for that signal to become active again, the systems uses known encryption technology which sequentially encrypts the signal on a very large number of different variations. Thus, it is unlikely that the same encryption will occur twice within any small time range. The known technology also preferably compensates for actuations of the transmitter that occur away from the system which is to be actuated. As an example, one may accidentally depress a button on the transmitter when away from the garage door opener. Thus, the receiver for the garage door opener will not know to advance its counter when evaluating the signal.

To address this concern, the known remote vehicle door opener receiver receives the signal and checks the signal against a large number of expected subsequent signals after the last received signal. The known receiver compares a newly received signal to the first expected signal subsequent to the last received, and determines whether the received is the expected signal. If not, it will continue to compare the newly received signal to the next expected signal, and continue to check the next 256 signals. Once an expected signal is identified as matching the received signal, then the process stops, and the system is actuated. The counter is also reset to the new number.

In this way, should one accidentally actuate the button on the transmitter when away from the system, the receiver still recognizes the signal. At the same time, since the encryption technology sequences and changes, a criminal may not merely capture one signal, and still actuate the system. The inventive transmitter and receiver preferably utilize this type of encryption logic.

In features of this invention, the transmitter may include buttons to actuate several different systems. Some of the systems may not be encrypted. As an example, the buttons to actuate the interior or exterior lights of a home need not be encrypted.

One embodiment transmitter is provided with electronics such that it may be adaptable to various types of receivers. The transmitter may be provided with plug-in modules to provide non-encrypted signals for particularly widely used receivers. As an example, light manufacturers often have a set of standard signals. The plug-in modules for the particular manufacturer allows the consumer to tailor the transmitter to his particular needs.

In another embodiment, the transmitter may be provided with the ability to transmit at varying frequencies such that it may be utilized in combination with many different type receivers. The transmitter may be provided with a receiver to learn a code and frequency for a particular receiver. Appropriate controls are provided in the transmitter to allow the transmitter to learn, or be programmed, to the required signal. As an example, when teaching the particular transmitter how to actuate the garage door, the original garage door opener is actuated, and the inventive transmitter captures that signal. The technology utilized to capture the signal is as known in the art, and forms no portion of this invention.

These and other features of the present invention will be best understood from the following specification and drawings, of which the following is a brief description.

DETAILED DESCRIPTION OF PREFERRED EMBODIMENTS

Figure 1:
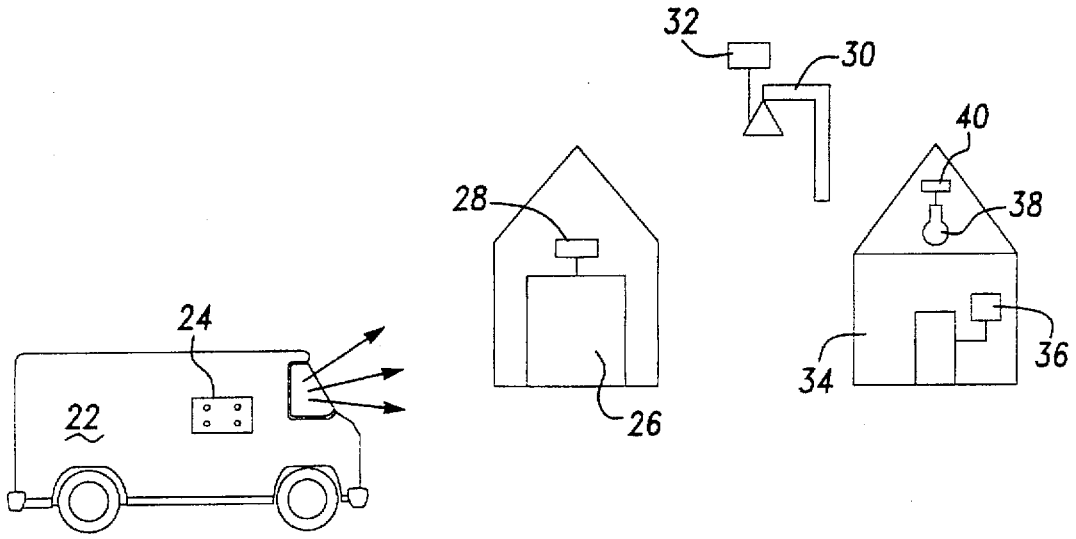
FIG. 1 is a schematic view of the inventive system.

A control 20 for actuating several systems at a user's home is illustrated in FIG. 1. The control includes a transmitter 24 actuatable from vehicle 22 as the user approaches/reaches the home. The disclosed transmitter 24 is operable to open a garage door 26 through a receiver control 28, actuate exterior lights 30 through receiver control 32, actuate an alarm system for the home 34 through a receiver control 36, and actuate the interior lights 38 through a receiver control 40. It should be understood that transmitters that control fewer or more systems may come within the scope of this invention.

The basic controls for actuating each of these systems are available in the prior art. The present invention discloses a unique transmitter and receiver for transmitting/receiving encrypting signals to actuate the systems.

Figure 2:
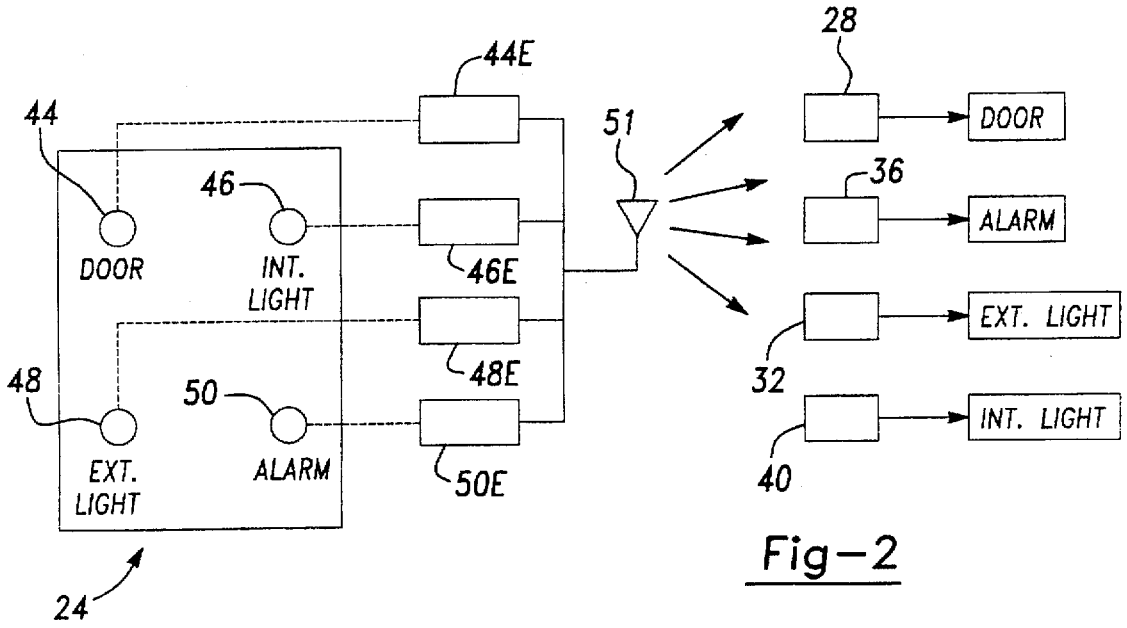
FIG. 2 shows a detail of the transmitter and receivers of the present invention.

As shown in FIG. 2, the transmitter 24 includes buttons 44 for the garage door, 46 for the interior lights, 48 for the exterior lights, and 50 for the security system. Each of these buttons actuates the transmission of a signal through its own channel and through a respective logic circuit 44E, 46E, 48E, 50E, and then to a transmitting antenna 51 to send the signal outwardly of transmitter 24. Typically each receiver 28, 32, 36 and 40 may receive the signal, and if the signal is acceptable, the respective system is actuated.

In this invention, the signals transmitted by the transmitter for at least some of the channels are encrypted to make any signal that a criminal may capture of no subsequent value.

Preferred patented encryption technology is available from United Technologies Automotive, Inc. of Dearborn, Mich. The prior technology has been used for remote vehicle door entry systems, and not for the applications of this invention. In the patented encryption technology, a transmitter and a receiver are both provided with logic that "knows" the sequential encrypted signals. If the receiver and transmitter both know that the signal has been actuated ten times, they both will know what encryption will be performed on the 11th iteration. Thus, the receiver is able to predict and recognize the encrypted signal.

Figure 3:
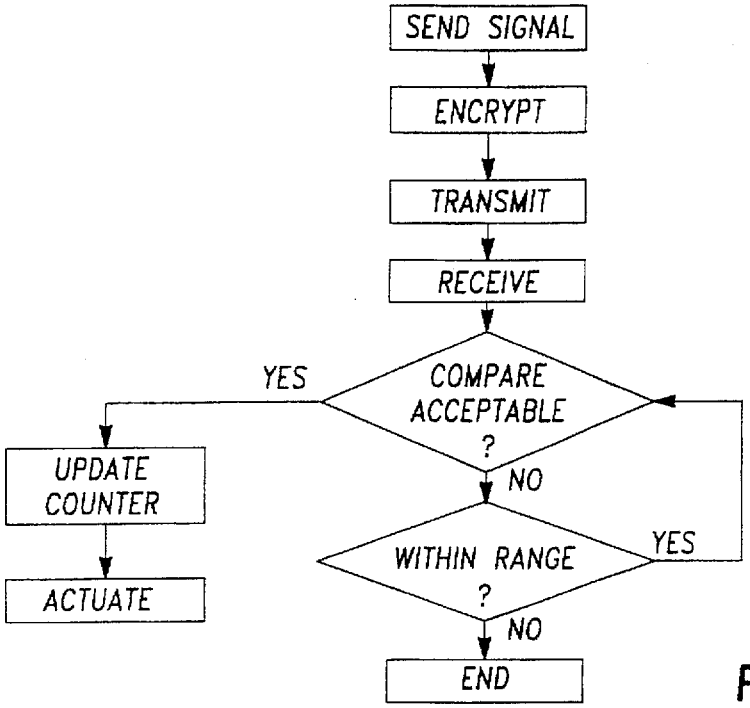
FIG. 3 is a flow chart of the operation of the inventive system.

FIG. 3 is a flow chart of the basic inventive method of operation. In a first step, an operator actuates one of the buttons 44, 46, 48 and 50 to send signal. The actuation causes the transmitter 24 to send an encrypted signal. A receiver then receives and checks the signal to determine if it is an expected, or acceptable, signal for the particular receiver. As an example, receivers 28, 32, 36 and 40 may all receive the same signal that is only directed toward the control receiver 36. The encryption logic is different for each receiver. Thus, the signal should only be found "acceptable" by the appropriate receiver 36. Upon receiving the signal, the receiver checks to see if it is an acceptable signal. In the particular preferred embodiment, the receiver and transmitter are both provided with encryption logic that sequences through a great number of different encrypted signals. The receiver has a counter which knows the last received signal, and thus would expect the next signal to be the next encrypted signal from the transmitter. Even so, the invention recognizes that it is possible an operator may have inadvertently actuated the particular button remote from the system such that the receiver would not have counted the particular actuation. Thus, the receiver is provided with the ability of checking the received signals with a range of next expected signals. In particular, the receiver is preferably equipped to check for the next 256 expected signals before determining that the signal received is not an acceptable signal.

As an example, when the receiver 28 receives a signal from the transmitter 24, it compares the received signal to the first expected signal to determine whether the newly received signal is an acceptable signal. If not, the receiver then proceeds to check the next 255 signals. If no matches are found within that range, then the receiver stops checking the signals, and determines that it was not an acceptable signal to actuate its system. If, however, during the range of expected signal, an acceptable signal is identified, then the system is actuated. The receiver 28 also adjusts its counter to the number of the received and matched signal. In this way, should there have been a number of actuations of the transmitter remote from the receiver 28, the receiver 28 is still capable of being actuated and adjusted.

Figure 4:
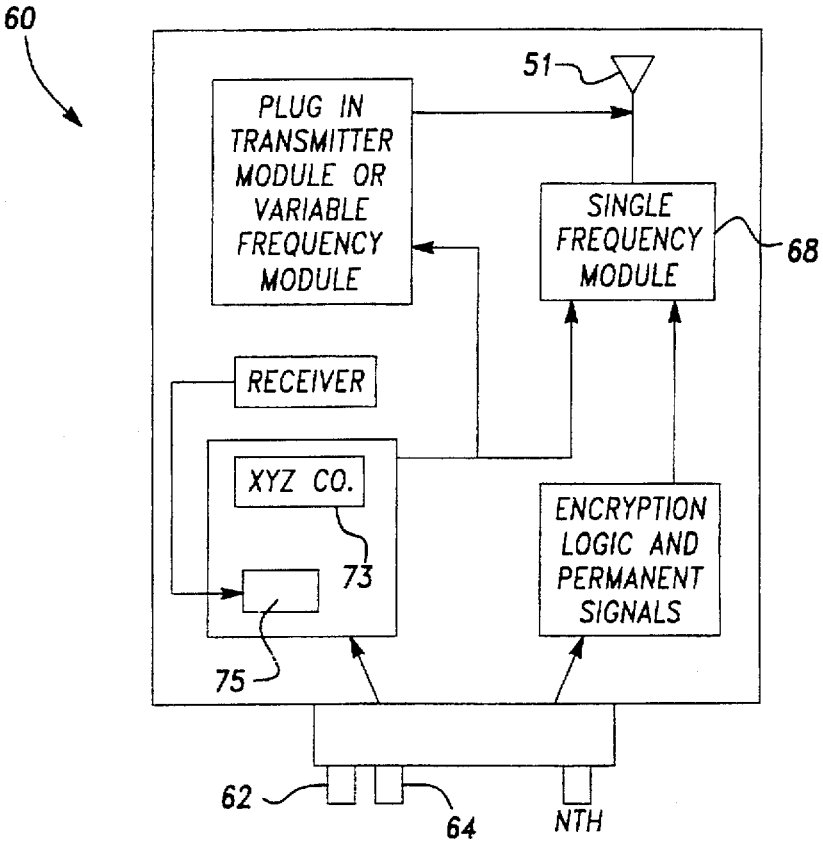
FIG. 4 shows a preferred embodiment transmitter.

FIG. 4 shows one preferred transmitter embodiment 60. As shown, a number of buttons, 62, 64 up to an nth button are included on the transmitter 60. The transmitter is provided with two main paths. A first path 66 proceeds through a code logic for encrypted signal. As mentioned above, each system has its own channel within path 66. Path 66 may also store a permanent signal for non-secure systems such as lights, etc. The signal leaving path 66 proceeds to a single frequency transmitter 68. Antenna 51 sends the signal to the receivers.

On an optional second path 72, plug-in modules 73 for known receiver brands may be added. As an example, many manufacturers of lighting systems, etc., have their own signalling protocols. The present invention allows the use of plug-in logic modules for the particular signals needed for the user's home system.

In addition, second path 72 may also be provided with a programmable logic 75, and an optional receiver 74 may be provided to receive and store signals in logic 75. Thus, a signal can be captured by the receiver 74 such that path 72 can "learn" the desired signal. As an example, a garage door opener can be actuated, and transmitter 60 can then capture the signal, and learn it is the appropriate signal for the garage door opener.

An optional multifrequency transmitter module, or variable frequency transmitter 76 may also be provided to send desired signals to antenna 70. In some applications, the several systems that are to be controlled by the transmitter 60 may operate at different frequencies. Thus, the transmitter may need to transmit at several different frequencies in some applications. The invention allows an operator to tailor a system to the particular frequencies needed.

Ideally, the system would be utilized with a group of receivers which are tailored for the particular transmitter, and which would all be operable under a single frequency. In such a case, the optional variable frequency transmitter 76 may not be necessary. In some applications, each of the receivers for the systems may be designed to be operable with the particular transmitter. However, in practice, it may be most useful to be able to modify existing systems to have a receiver such that they will be able to recognize the transmitted signals.

Figure 5A:
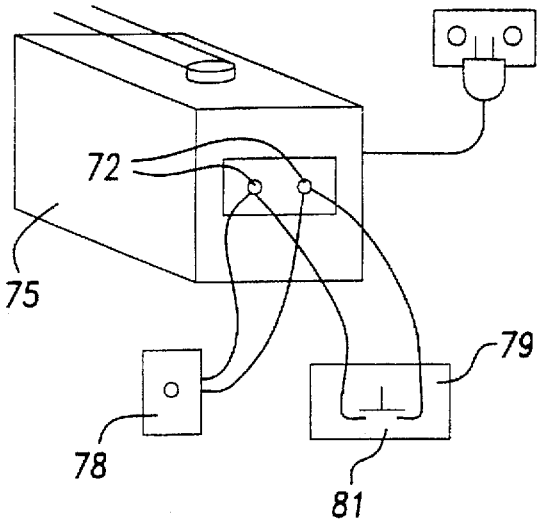
FIG. 5A shows the incorporation of a receiver into an existing garage door system.

FIG. 5A shows a system for modifying a garage door opener 75. Garage door openers 75 typically have terminals 77 which communicate with a control system for the door opener. As an example, the wall switch 78 communicating with the garage door opener typically sends an actuation signal to terminals 77. An encrypted receiver unit 79 is attached to the screw terminal 75. The encrypted receiver unit operates as described above, and recognizes the encrypted signals as described above. Upon receipt of an acceptable signal, receiver 79 actuates a switch 81 that functions as if an operator has actuated the switch 74. The garage door thus opens or closes. The invention is thus able to easily modify the existing controls.

Figure 5B:
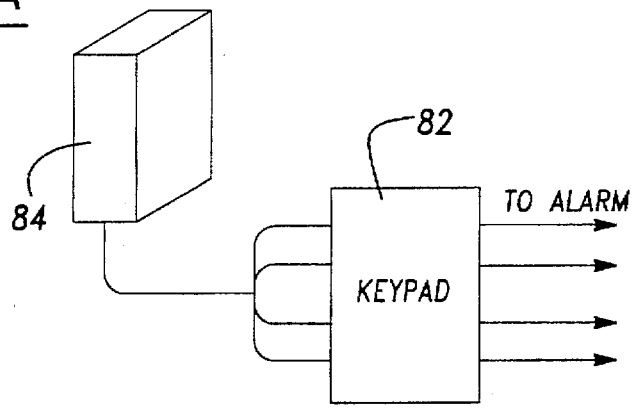
FIG. 5B shows the incorporation of a receiver into an existing home alarm system.

FIG. 5B shows a system 80 for incorporating an encrypted receiver 84 into a home alarm system. As shown, the alarm system key pad 24 is electrically connected to an encrypted receiver 84. The encrypted receiver 84 includes logic such that upon receipt of an acceptable signal it sends a signal equivalent to entry of the proper code in the key pad which disables or enables the alarm system.

The electronics necessary to perform the above receiver functions are well within the skill of a worker in the art. It is the application and arrangement of components which are inventive.

Figure 5C:
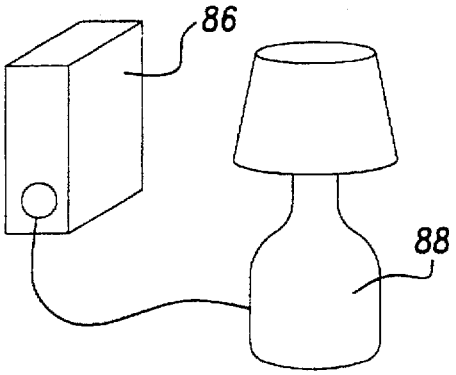
FIG. 5C shows the incorporation of a light actuation receiver.
Figure 5D:
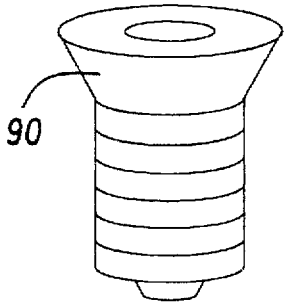
FIG. 5D shows a second embodiment for controlling the actuation of a light.

FIG. 5C shows a plug-in unit 86 which may be plugged into a wall outlet. A lamp 88 is plugged into the unit 86. The unit 86 is provided with appropriate logic circuitry such that it is able to identify a proper signal from the transmitter and actuate the light 88 as desired. FIG. 5D shows a bulb receiver 90 which is also provided with appropriate logic such that it can identify the appropriate signal from a transmitter.

The present invention allows an operator to utilize a single transmitter, and control multiple home systems. It will be most difficult for a criminal to capture the encrypted signals and then actuate the systems. Although preferred embodiments of this invention have been disclosed, a worker of ordinary skill in this art would recognize that certain modifications would come within the scope of this invention. For that reason, the following claims should be studied to determine the true scope and content of this invention.

I claim:

1. A method of actuating at least one home security system remotely comprising the steps of:

(1) providing a transmitter with encryption logic to send an encrypted signal, providing a receiver adapted to identify an expected encrypted signal, said receiver being adapted to actuate a home security system said encryption logic sending signals that change sequentially, and thus are different on each actuation of said transmitter, said changing sequentially different signals being predictable to said receiver;

(2) sending an encrypted signal from said transmitter;

(3) receiving said signal at said receiver, and comparing said received signal to an expected signal; and (4) actuating said system if said received signal is determined to be as expected in step 3.

2. A method as recited in claim 1, wherein said home security system is one of a garage door opener and a home alarm system.

3. A method as recited in claim 2, wherein when said receiver receives said signal, and begins comparing said received signal to an expected signal beginning with the signal after a last received acceptable signal received by said receiver.

4. A method as recited in claim 1, wherein there are a plurality of systems controlled by signals sent by said transmitter, and at least one of said systems receiving a non-encrypted signal from said transmitter.

5. A method as recited in claim 4, wherein at least one of said systems is provided with an add-on receiver having encryption logic, said add-on receiver being incorporated into the existing circuitry for said system.

6. A method as recited in claim 5, wherein said add-on receiver is provided with circuitry such that when an acceptable signal is received, a signal is generated to the system to actuate the system.

7. A method as recited in claim 6, wherein said system which receives said add-on receiver is a garage door opener.

8. A method as recited in claim 6, wherein said system which receives said add-on receiver is a home alarm system.

9. A system for controlling security systems at a home comprising:

a transmitter, provided with a plurality of buttons, separate channels associated with each of said buttons such that when one of said buttons is actuated, a signal is transmitted by said transmitter, and at least one of said channels being provided with encryption logic such that an encrypted signal is transmitted by said at least one channel said encryption logic in said transmitter causing signal to be sequentially different upon each actuation of said transmitter;

a receiver for receiving said transmitted signals, said receiver being provided with encryption logic such that it can recognize said changing different encrypted transmitted signals; and said receiver adapted to be connected into a home security system, such that said receiver is operable to actuate said home security system.

10. A system as recited in claim 9, wherein said transmitter includes buttons to actuate a garage door opener and a home alarm system, and there are receivers provided for each of the garage door opener and the home alarm system.

11. A system as recited in claim 9, wherein said receivers for the garage door opener and the home alarm system are both add-on receivers to be incorporated into the existing circuitry for the garage door opener and the home alarm system.

12. A method of controlling home security systems comprising the steps of:

(1) providing a transmitter with at least one button, said button being operable to actuate at least one of a garage door opener and a home alarm system, and said transmitter also being operable to encrypt a signal for said at least one of a garage door opener and a home alarm system, providing a receiver for at least said one of a garage door opener and a home alarm system, said receiver being operable to receive and recognize an encrypted signal and compare the signal to an expected signal, said receiver being operable to actuate its system if said received signal corresponds to an expected signal said encryption logic for said transmitter and said receiver sequentially encrypting and changing the signal, said receiver having a counter storing a last received acceptable signal, said receiver beginning its comparison of expected signals with the next expected signal after said last received signal;

(2) actuating said button and transmitting an encrypted signal;

(3) receiving said signal, comparing said received signal to an expected signal; and (4) actuating said system if said received signal corresponds to said expected signal.

13. A method as recited in claim 12, wherein said at least one of a garage door opener and a home alarm system has an add-on receiver incorporated into its existing circuitry, said receiver being provided with encryption logic.

* * * * *